US012065327B2

(12) United States Patent
Endo

(10) Patent No.: US 12,065,327 B2
(45) Date of Patent: Aug. 20, 2024

(54) PRINTING APPARATUS

(71) Applicant: Seiko Epson Corporation, Tokyo (JP)

(72) Inventor: Katsuyuki Endo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 163 days.

(21) Appl. No.: 17/648,244

(22) Filed: Jan. 18, 2022

(65) Prior Publication Data

US 2022/0227598 A1 Jul. 21, 2022

(30) Foreign Application Priority Data

Jan. 19, 2021 (JP) ..... 2021-006186

(51) Int. Cl.
*B65H 35/00* (2006.01)

(52) U.S. Cl.
CPC ..... *B65H 35/0086* (2013.01); *B65H 2553/41* (2013.01); *B65H 2801/09* (2013.01)

(58) Field of Classification Search
CPC ..... B65H 35/0086; B65H 2553/41; B65H 2801/09
See application file for complete search history.

(56) References Cited

U.S. PATENT DOCUMENTS

| | | | | |
|---|---|---|---|---|
| 6,447,189 | B1 | 9/2002 | Omura | |
| 9,393,816 | B2 | 7/2016 | Takabatake et al. | |
| 10,449,788 | B2 * | 10/2019 | Fujiwara | B41J 11/703 |
| 11,052,680 | B2 | 7/2021 | Tokuda | |
| 2014/0186088 | A1 | 7/2014 | Takabatake et al. | |
| 2020/0230979 | A1 | 7/2020 | Tokuda | |
| 2020/0230980 | A1 * | 7/2020 | Tokuda | B41J 15/042 |

FOREIGN PATENT DOCUMENTS

| | | | |
|---|---|---|---|
| CN | 107116913 | | 9/2017 |
| CN | 111452520 | | 7/2020 |
| JP | 2010-274379 | | 12/2010 |
| JP | 2020-116658 | A | 1/2019 |
| JP | 2020-116658 | | 8/2020 |
| KR | 2006-0021419 | A | 3/2006 |
| KR | 20060021419 | | 3/2006 |
| WO | 2010-137252 | | 12/2010 |

* cited by examiner

*Primary Examiner* — Christopher E Mahoney
*Assistant Examiner* — Marissa Ferguson-Samreth
(74) *Attorney, Agent, or Firm* — WORKMAN NYDEGGER

(57) ABSTRACT

A printing apparatus includes: a first blade that cuts a printing medium; a cutter motor; a drive gear that engages the first blade and is rotated by the cutter motor to drive the first blade; a rotator that rotates in conjunction with the drive gear; a photosensor that includes a light-receiving/emitting section including a light-emitting element and a light-receiving element and that includes a sensor substrate that outputs a first detection signal or a second direction signal in accordance with whether or not detection light emitted from the light-emitting element to the light-receiving element is blocked by the rotator; a first cutter frame that supports the photosensor; and a cover member that covers the sensor substrate between the cover member and the first cutter frame.

12 Claims, 12 Drawing Sheets

PRINTING APPARATUS

The present application is based on, and claims priority from JP Application Serial Number 2021-006186, filed Jan. 19, 2021, the disclosure of which is hereby incorporated by reference herein in its entirety.

BACKGROUND

1. Technical Field

The present disclosure relates to a printing apparatus.

2. Related Art

As disclosed in JP-A-2010-274379, a printer that includes a home-position detection sensor of a switch type for detecting a home position of a cutter is known.

When the printer uses, instead of the home-position detection sensor of the switch type, an optical sensor including a light-emitting element and a light-receiving element, foreign substances, such as grease spattered from a cutter drive section and paper dust generated during paper cutting, may enter the optical sensor.

SUMMARY

A printing apparatus of the disclosure includes: a first blade configured to cut a printing medium; a cutter motor; a drive gear configured to engage the first blade and configured to be rotated by the cutter motor to drive the first blade; a rotator configured to rotate in accordance with rotation of the drive gear; a photosensor configured to output a detection signal in accordance with rotation of the rotator and configured to include a light-receiving/emitting section including a light-emitting element and a light-receiving element and a sensor substrate at which the light-receiving/emitting section is provided, a first cutter frame configured to support the photosensor; and a cover member configured to cover the sensor substrate, wherein the sensor substrate is provided between the cover member and the first cutter frame.

A printing apparatus of the disclosure includes: a first blade configured to cut a printing medium; a cutter motor; a drive gear configured to engage the first blade and configured to be rotated by the cutter motor to drive the first blade; a rotator configured to rotate in accordance with rotation of the drive gear; a photosensor configured to output a detection signal in accordance with rotation of the rotator and configured to include a light-receiving/emitting section including a light-emitting element and a light-receiving element and a sensor substrate at which the light-receiving/emitting section is provided, a first cutter frame configured to rotatably support the drive gear; and a cover member configured to include at least one of a first annular wall located along an inner side of a rotation path of the rotator and a second annular wall located along an outer side of the rotation path.

DESCRIPTION OF EXEMPLARY EMBODIMENTS

Figure 1:
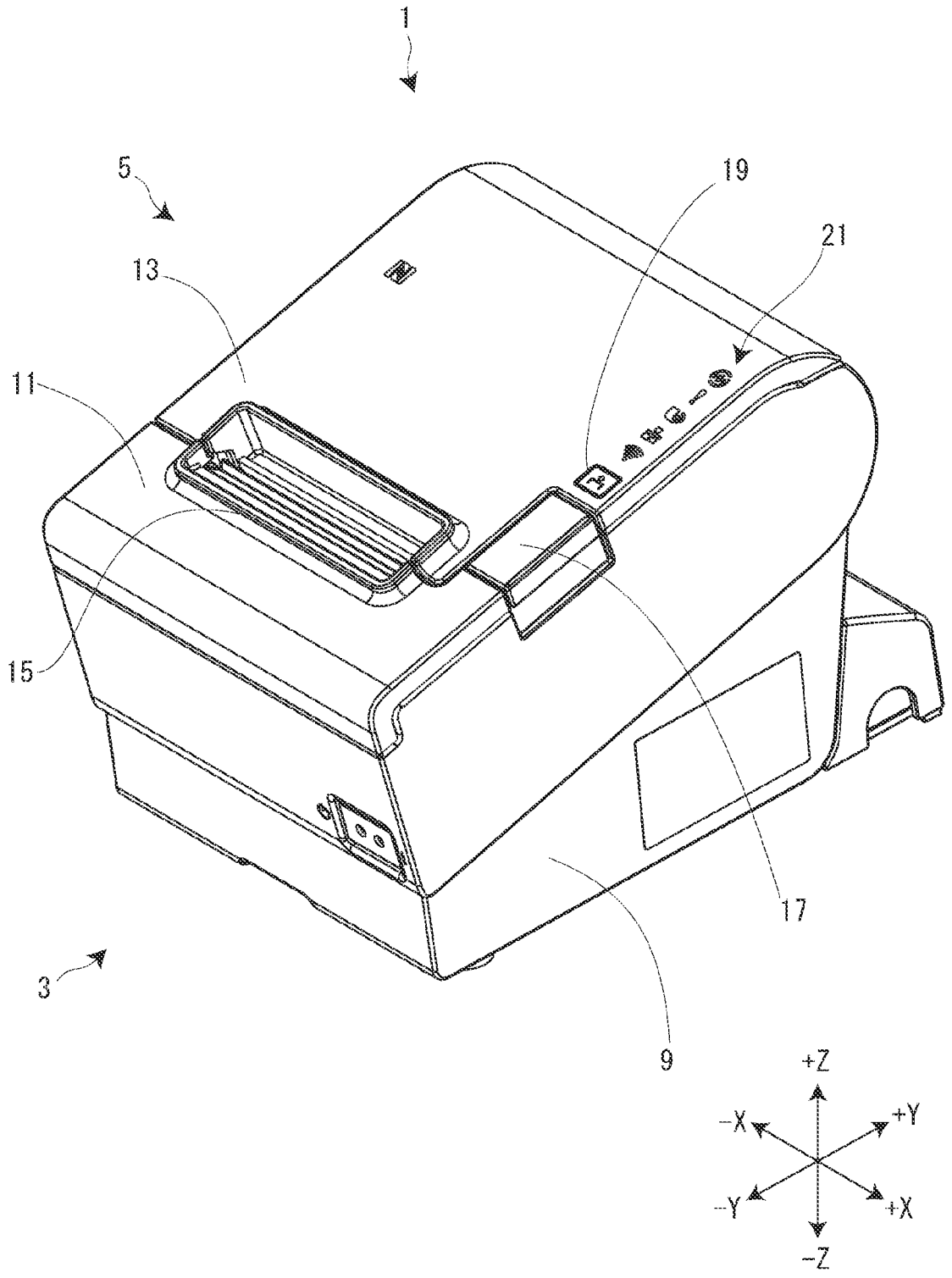
FIG. 1 is a perspective view of a printing apparatus in which an opening/closing cover is closed.

An embodiment of a printing apparatus will be described below with reference to the accompanying drawings. A printing apparatus 1 of the present embodiment is used as, for example, a receipt printer in a POS system. The following description will be given with directions in the XYZ orthogonal coordinate system illustrated in the drawings. However, such directions are used merely for convenience of description and should not limit the embodiment described below. Note that the vertical direction corresponds to the Z direction in FIGS. 1 to 4, and a direction parallel to a rotational axis of a drive gear 59 illustrated in FIG. 5 corresponds to the Z direction in FIGS. 5 to 14.

External Structure of Printing Apparatus

Figure 2:
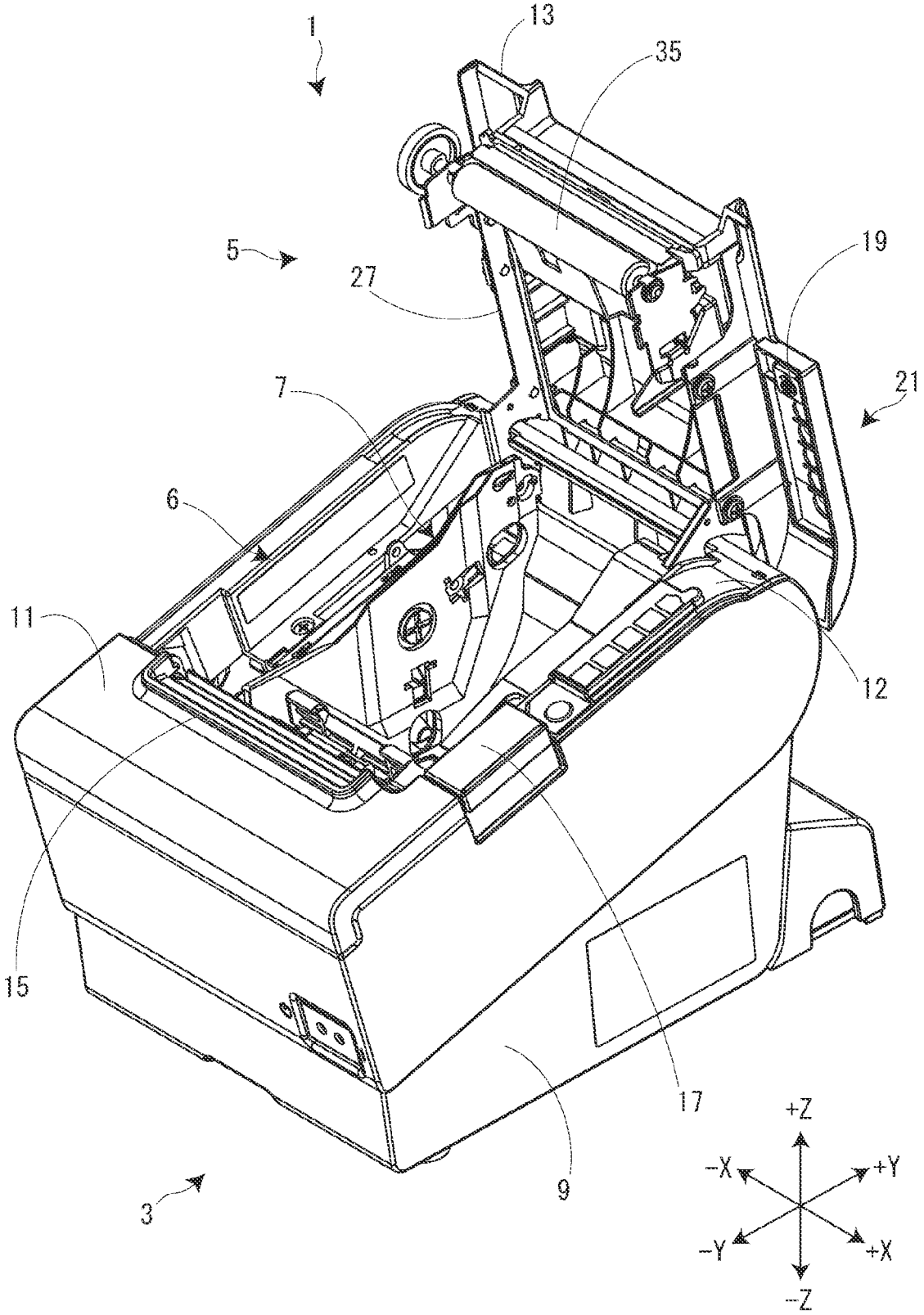
FIG. 2 is a perspective view of the printing apparatus in which the opening/closing cover is opened.

An external structure of the printing apparatus 1 will be described with reference to FIGS. 1 and 2. The printing apparatus 1 includes an apparatus main body 3 and an opening/closing cover 5. The apparatus main body 3 has a substantially rectangular parallelepiped shape and includes an opening 6 on the +Z direction side, and a paper-roll container 7 is provided in the apparatus main body 3. A paper roll R obtained by rolling recording paper P, which is a printing medium, into a roll shape is accommodated in the paper-roll container 7 (refer to FIG. 3). The opening/closing cover 5 is attached to the +Y direction end of the apparatus main body 3 so as to be rotationally movable and opens/closes the opening 6.

The exterior of the printing apparatus 1 is constituted by a main body outer case 9, a cutter unit cover 11, an opening outer case 12, and a cover outer case 13.

The exterior of the apparatus main body 3 is constituted by the main body outer case 9, the cutter unit cover 11, and the opening outer case 12. The main body outer case 9 has a substantially rectangular parallelepiped box shape that is open on the +Z direction side. The cutter unit cover 11 is provided in the −Y direction with respect to the opening/closing cover 5. Opening the cutter unit cover 11 exposes an automatic cutter 37 (refer to FIG. 3) described later. A discharge port 15 is provided at a boundary between the cutter unit cover 11 and the opening/closing cover 5. The recording paper P drawn from the paper roll R accommodated in the paper-roll container 7 is discharged from the discharge port 15. The opening outer case 12 is provided in an edge portion of the opening 6. The exterior of the opening/closing cover 5 is constituted by the cover outer case 13.

The printing apparatus 1 includes a cover open button 17, a feed button 19, and a panel 21. The cover open button 17, the feed button 19, and the panel 21 are provided in the +X direction end on the +Z direction surface of the printing apparatus 1. When the cover open button 17 is pressed, the opening/closing cover 5 is opened. When the feed button 19 is pressed, a platen roller 35 described later rotates, and the recording paper P is fed to the discharge port 15. The panel 21 displays various information about an error or the like for a user.

Internal Structure of Printing Apparatus

An internal structure of the printing apparatus 1 will be described with reference to FIGS. 3 and 4. The printing apparatus 1 includes a base frame 23, a main body frame 25, a cover frame 27, a thermal head 29, a feed motor 31, a gear train 33, the platen roller 35, the automatic cutter 37, and a lock mechanism 39.

The base frame 23 and the main body frame 25 are provided in the main body outer case 9. The base frame 23 supports the main body frame 25. The main body frame 25 includes a first main body frame 41 and a second main body frame 43. Both the first main body frame 41 and the second main body frame 43 have a substantially rectangular plate shape extending in the Y direction. The second main body frame 43 is provided in the +X direction with respect to the first main body frame 41. A cover support shaft 45 extending in the X direction is provided in the +Y direction end of the first main body frame 41 and the +Y direction end of the second main body frame 43.

The cover frame 27 is provided in the cover outer case 13. The cover frame 27 has a substantially rectangular frame shape and is supported by the main body frame 25 via the cover support shaft 45 so as to be rotationally movable. A shaft hole for the cover support shaft (not illustrated) that engages the cover support shaft 45 is provided in the +Y direction end of the cover frame 27.

The thermal head 29 is supported by the main body frame 25. The thermal head 29 includes a plurality of heating elements (not illustrated) and performs printing on the recording paper P drawn from the paper roll R.

The feed motor 31 is fixed to the −Y direction end of the first main body frame 41. The feed motor 31 is a drive source of the platen roller 35. Note that, for example, a direct current (DC) motor may be used as the feed motor 31.

The gear train 33 is provided in the first main body frame 41. The gear train 33 includes a plurality of gears and transfers power of the feed motor 31 to the platen roller 35.

The platen roller 35 is rotatably supported by the −Y direction end of the cover frame 27. When the opening/closing cover 5 is closed, the platen roller 35 faces the thermal head 29. A force is applied by a roller spring (not illustrated) such that the platen roller 35 is directed toward the thermal head 29. Thus, the platen roller 35 holds the recording paper P against the thermal head 29. The platen roller 35 feeds the recording paper P held against the thermal head 29 to the discharge port 15. That is, when the platen roller 35 rotates, the recording paper P is drawn from the paper roll R and fed to the discharge port 15.

A roller gear 47, which is located in the −X direction with respect to the platen roller 35, is provided on the same shaft as the platen roller 35. The roller gear 47 engages a transfer gear 49 of the gear train 33 and rotates integrally with the platen roller 35.

The automatic cutter 37 is provided between the platen roller 35 and the discharge port 15 and cuts the recording paper P, which has been fed to the discharge port 15, on a rear side of a printed portion in the X direction, that is, a width direction of the recording paper P. Note that the automatic cutter 37 cuts the recording paper P while the −X direction end of the recording paper P remains uncut such that the cut recording paper P stays in the discharge port 15.

Automatic Cutter

Figure 3:
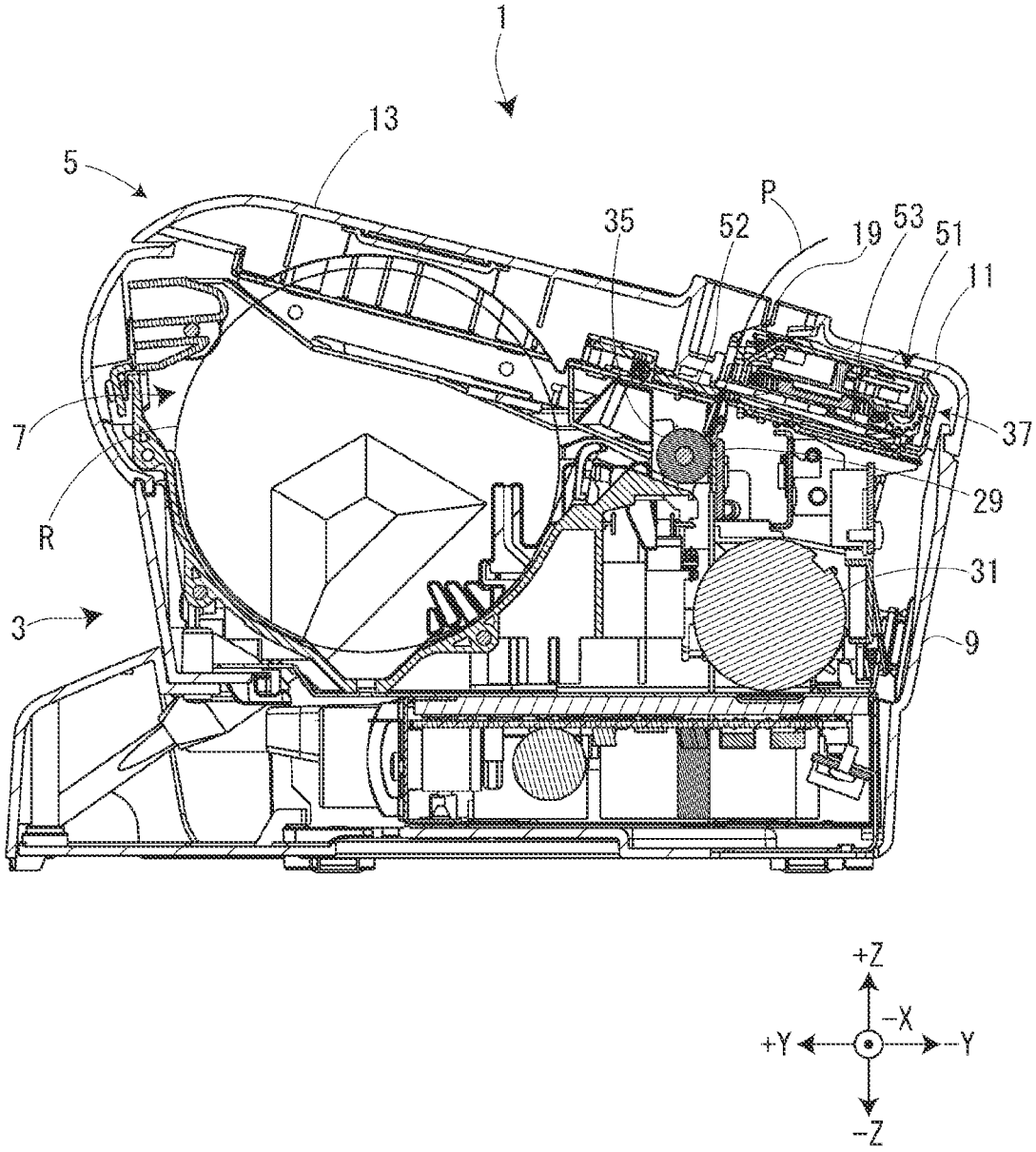
FIG. 3 is a sectional view of the printing apparatus.
Figure 4:
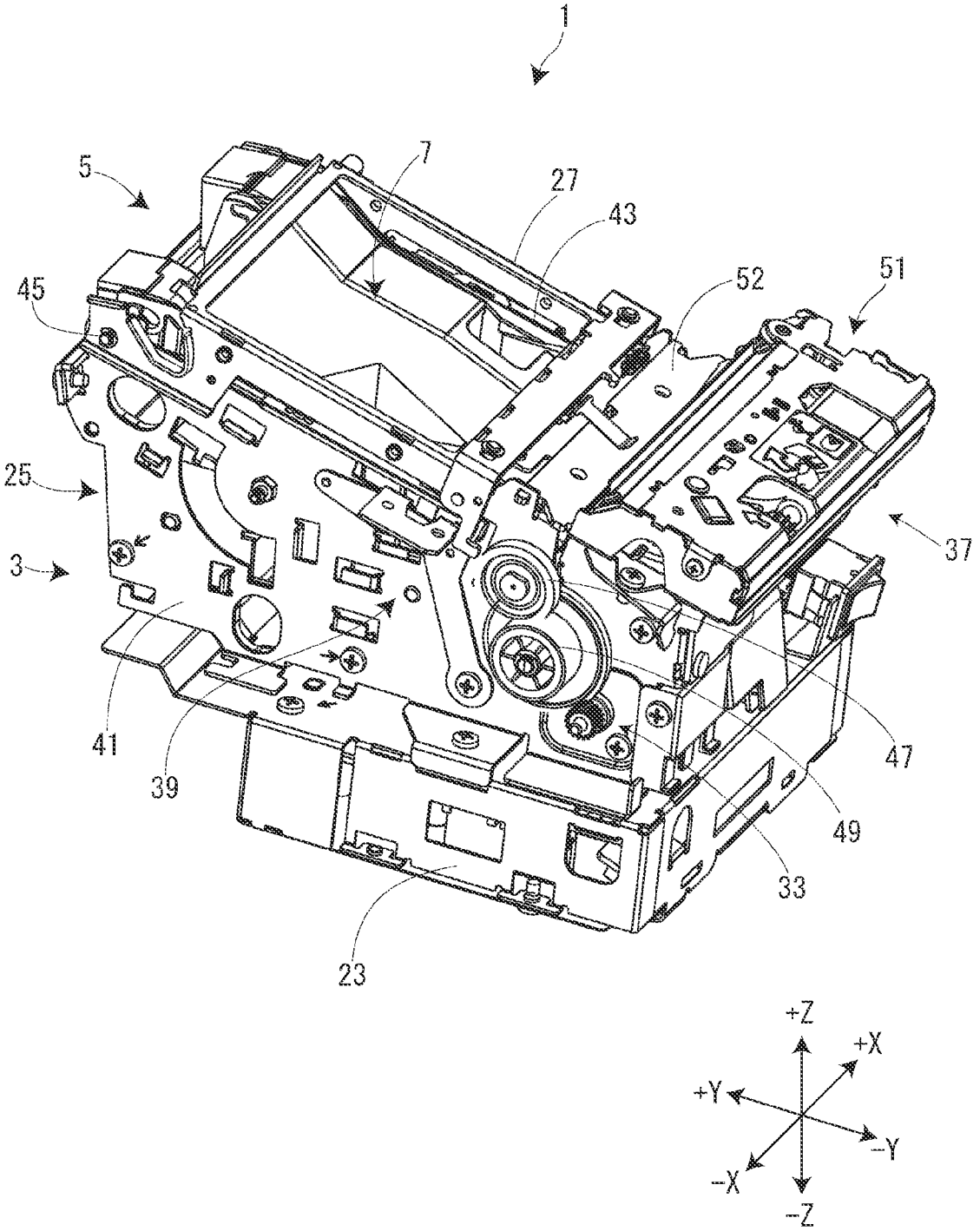
FIG. 4 is a perspective view of an internal structure of the printing apparatus.

As illustrated in FIGS. 3 and 4, the automatic cutter 37 includes a cutter unit 51 and a second blade 52. The cutter unit 51 is provided in the −Y direction end of the first main body frame 41 and the −Y direction end of the second main body frame 43 across a space between the first main body frame 41 and the second main body frame 43. The second blade 52 is provided in the −Y direction end of the cover frame 27 so as to face a first blade 53 of the cutter unit 51 when the opening/closing cover 5 is closed. When the first blade 53, which is a movable blade, is operated with respect to the second blade 52, which is a fixed blade, to perform cutting, the recording paper P is cut.

Figure 5:
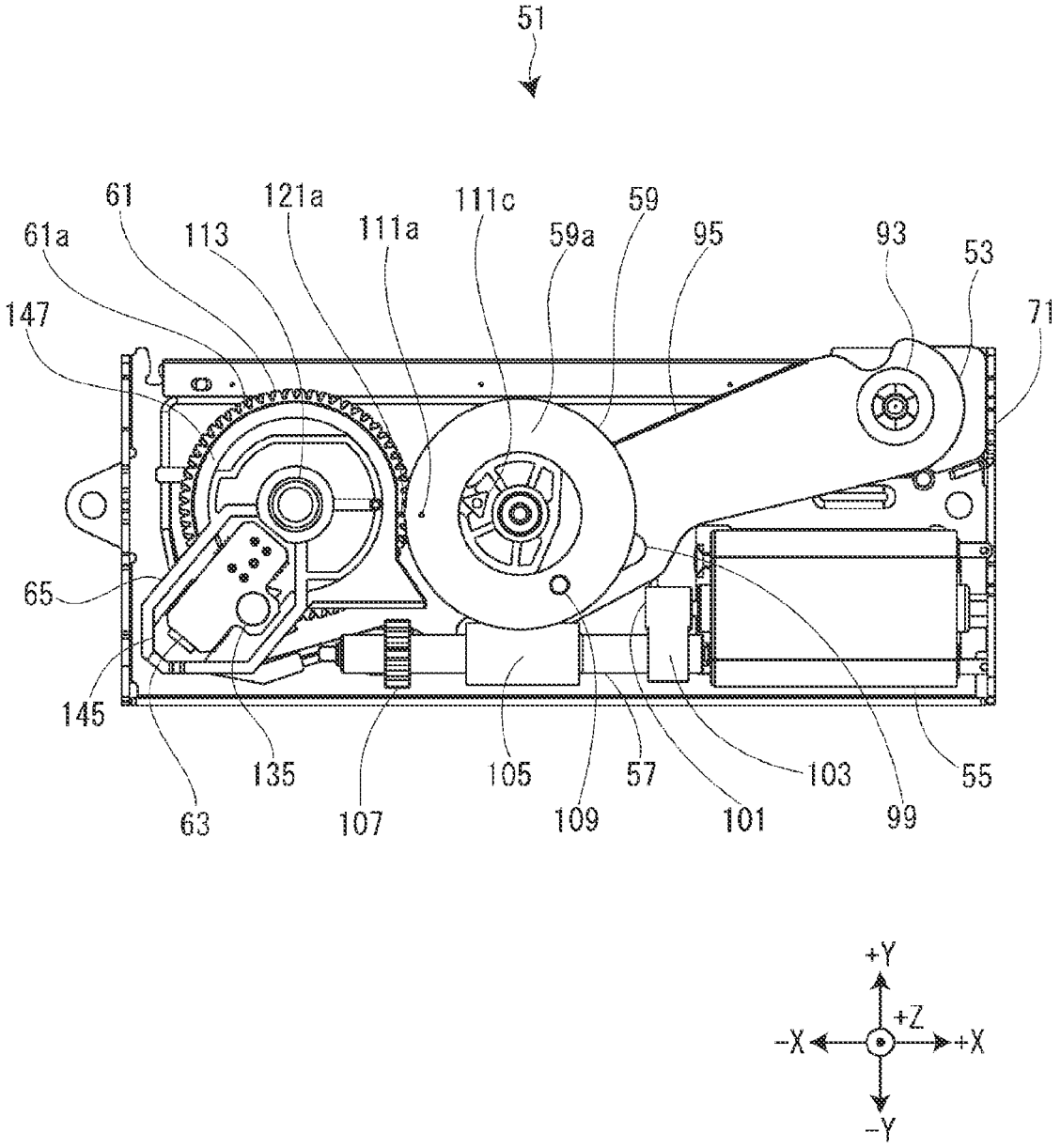
FIG. 5 illustrates a cutter unit, excluding a first cutter frame, viewed from the +Z direction side.
Figure 6:
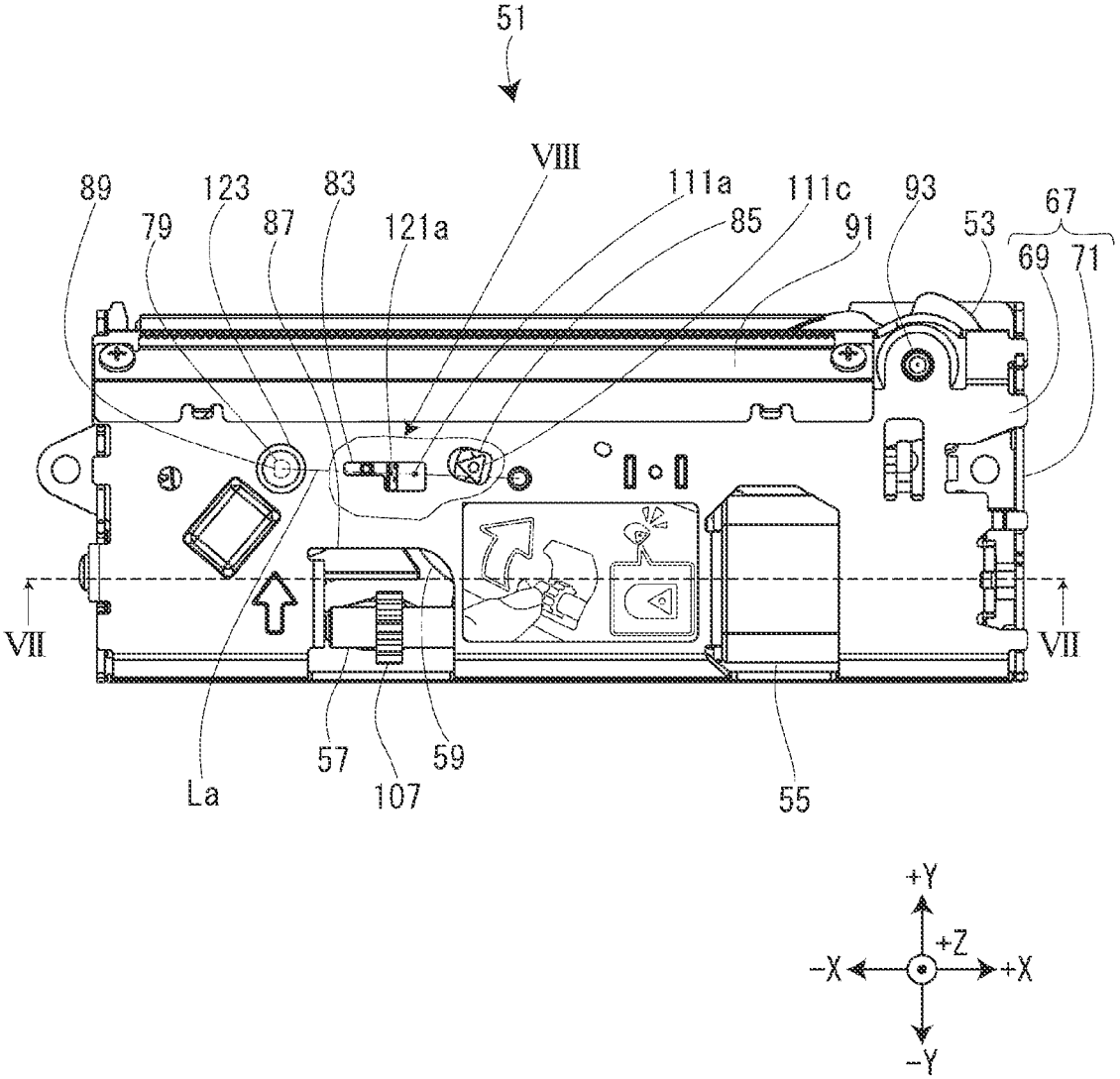
FIG. 6 illustrates the cutter unit viewed from the +Z direction side.

As illustrated in FIGS. 5 and 6, the cutter unit 51 includes the first blade 53, a cutter motor 55, a power transfer member 57, the drive gear 59, a detection gear 61, a photosensor 63, a cover member 65, and a cutter frame 67 in which the above-described components are accommodated.

The cutter frame 67 has a flat substantially rectangular parallelepiped case shape. The cutter frame 67 includes a first cutter frame 69 and a second cutter frame 71. The first cutter frame 69 and the second cutter frame 71 are detachably combined with each other by, for example, a small screw. The second cutter frame 71 is provided in the −Z direction with respect to the first cutter frame 69. The first blade 53, the cutter motor 55, the power transfer member 57, the drive gear 59, the detection gear 61, the photosensor 63, and the cover member 65 are accommodated between the second cutter frame 71 and the first cutter frame 69. The cutter motor 55, the power transfer member 57, the drive gear 59, the detection gear 61, the photosensor 63, and the cover member 65 are supported by the first cutter frame 69 (refer to FIG. 10). On the other hand, the first blade 53 is supported by the second cutter frame 71 (refer to FIG. 9). Note that the first cutter frame 69 may be referred to as a first cutter cover, and the second cutter frame 71 may be referred to as a second cutter cover.

Figure 7:
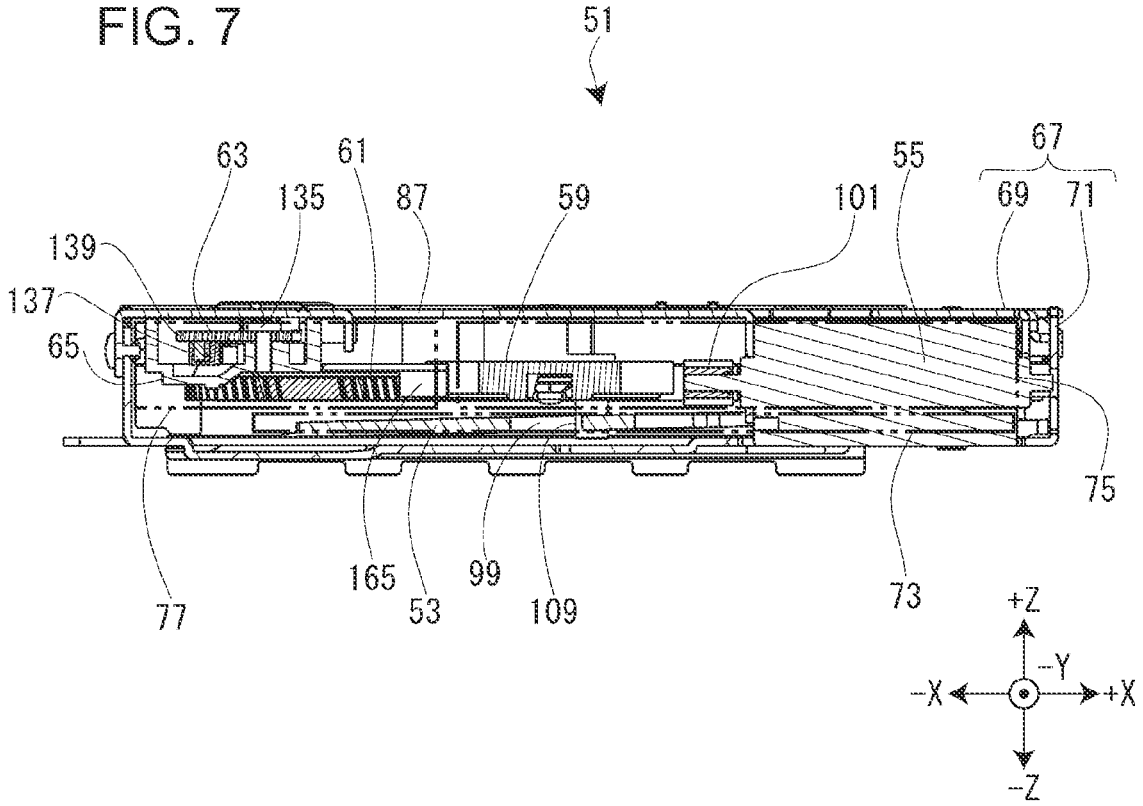
FIG. 7 is a sectional view along line VII-VII in FIG. 6.

Here, a region in which the first blade 53 rotationally moves is referred to as a blade rotational-movement region 73. A region in which the cutter motor 55, the power transfer member 57, and the drive gear 59 are provided is referred to as a drive region 75. A region in which the detection gear 61, the photosensor 63, and the cover member 65 are provided is referred to as a detection region 77. As described above, of the components accommodated in the cutter frame 67, the first blade 53 is supported by the second cutter frame 71, and the other components are supported by the first cutter frame 69. Thus, as illustrated in FIG. 7, the drive region 75 and the detection region 77 are provided side by side in the X direction between the blade rotational-movement region 73 and the first cutter frame 69. As a result, space in the cutter frame 67 is able to be used efficiently, thus achieving a reduction in size of the cutter unit 51.

The first cutter frame 69 includes a shaft engaging hole 79, a first mark opening 83, a second mark opening 85, and an operation opening 87.

The shaft engaging hole 79 engages a first shaft end 125 of a detection gear shaft 113 described later (refer to FIG. 11). The shaft engaging hole 79 is a D-shaped hole the −X direction end of which extends linearly. The linear portion of the shaft engaging hole 79 is referred to as a hole linear section 89.

The first mark opening 83 is provided at a position corresponding to a portion in which the drive gear 59 engages the detection gear 61. The second mark opening 85 is provided between the first mark opening 83 and the rotational center of the drive gear 59. The operation opening 87 is provided in the −Y direction with respect to the first mark opening 83.

Note that a manual cutter 91 is provided outside the first cutter frame 69, that is, on the +Z direction surface of the first cutter frame 69. The manual cutter 91 enables the user to tear off the recording paper P by hand.

Figure 9:
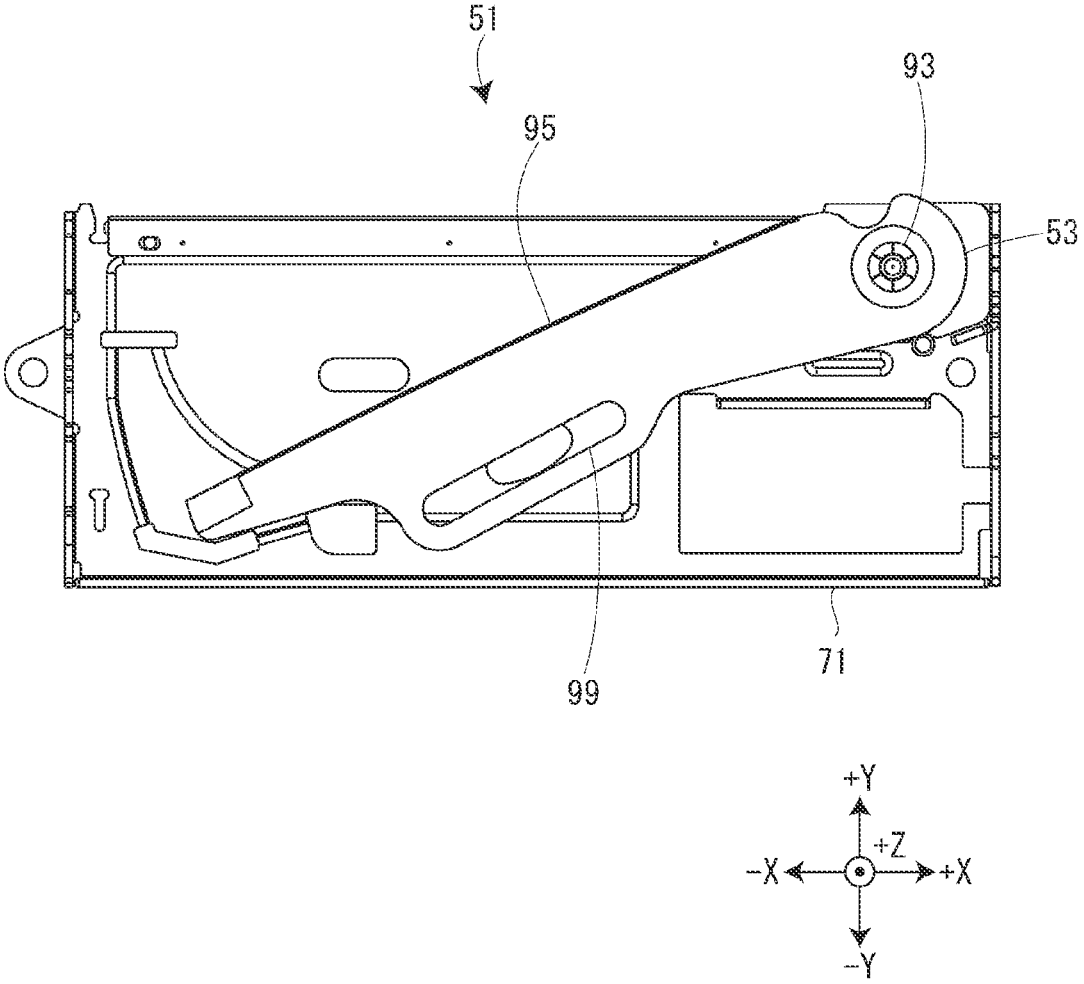
FIG. 9 illustrates components of the cutter unit, which are supported by a second cutter frame.

As illustrated in FIG. 9, a cutter support shaft 93 is provided in a corner of the second cutter frame 71, which is located in the +X direction and the +Y direction. The cutter support shaft 93 supports the first blade 53 such that the first blade 53 is rotationally movable.

The first blade 53 is supported by the second cutter frame 71 via the cutter support shaft 93 so as to be rotationally movable. The first blade 53 includes a first cutting edge 95, a shaft hole for the cutter support shaft (not illustrated), and a cutter engaging hole 99. The first cutting edge 95 extends in the longitudinal direction of the first blade 53. The shaft hole for the cutter support shaft is provided in one end of the first blade 53 in the longitudinal direction, that is, the +X direction end of the first blade 53. The cutter support shaft 93 is inserted into the shaft hole for the cutter support shaft. The cutter engaging hole 99 is provided in the vicinity of the back of the first blade 53 and is a rectangle with rounded ends elongated in the longitudinal direction of the first blade 53. The cutter engaging hole 99 engages a drive pin 109 (refer to FIG. 10) provided in the drive gear 59.

Here, a position at which the first blade 53 starts a cutting operation is referred to as a cutting start position. The cutting start position of the first blade 53 is a position at which the first blade 53 is farthest from the second blade 52. On the other hand, a position at which the first blade 53 performs cutting-into processing by approaching the second blade 52 such that the first cutting edge 95 of the first blade 53 is substantially parallel to a second cutting edge (not illustrated) of the second blade 52 extending in the X direction is referred to as a cutting-into position. The first blade 53 illustrated in the drawings, such as in FIG. 9, is at the cutting start position. Note that the cutting start position may be referred to as a standby position, and the cutting-into position may be referred to as a cutting position.

Figure 10:
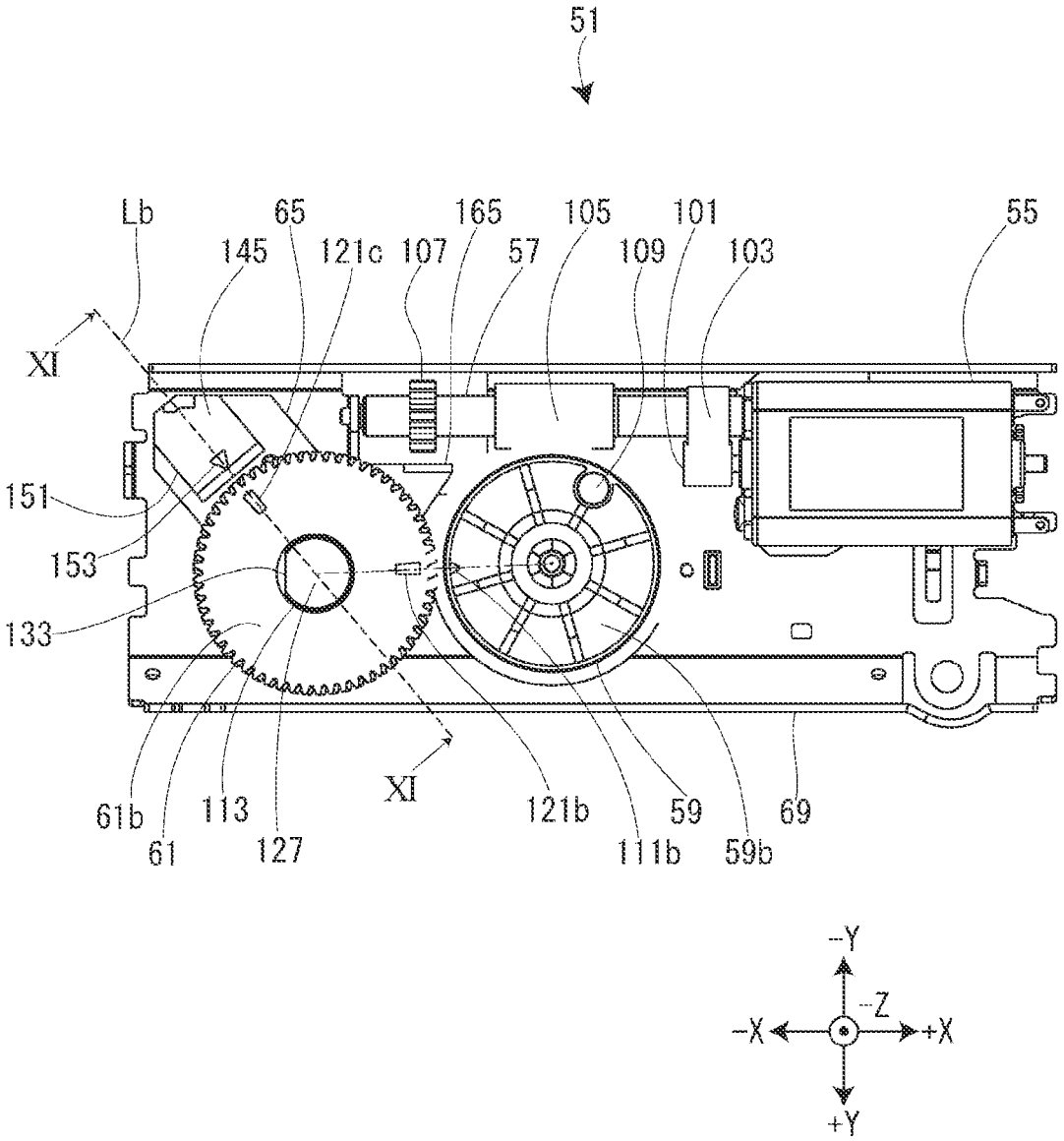
FIG. 10 illustrates components of the cutter unit, which are supported by a first cutter frame.

As illustrated in FIG. 10, the cutter motor 55 is located in the +X direction end of the first cutter frame 69 and fixed to the first cutter frame 69. The cutter motor 55 is a drive source of the first blade 53. An output gear 101 is provided in an output shaft of the cutter motor 55. For example, a DC motor may be used as the cutter motor 55.

The power transfer member 57 is located in the −Y direction end of the first cutter frame 69 and rotatably supported by the first cutter frame 69. The power transfer member 57 transfers power of the cutter motor 55 to the drive gear 59. The power transfer member 57 has a substantially column-like shape as a whole and extends in the X direction. The power transfer member 57 includes a first gear section 103, a second gear section 105, and an operation section 107 in this order from the +X direction side, that is, in order from the cutter motor 55. The first gear section 103, the second gear section 105, and the operation section 107 rotate integrally.

The first gear section 103 engages the output gear 101. The second gear section 105 engages the drive gear 59. Here, the output gear 101 and the power transfer member 57 rotate about an axis parallel to the X-axis direction. On the other hand, the drive gear 59 and the detection gear 61 rotate about an axis parallel to the Z-axis direction. That is, the second gear section 105 and the drive gear 59 correspond to a worm and a worm wheel, respectively.

The operation section 107 has a substantially short column shape, and a plurality of grooves extending in an axial direction of the operation section 107 are provided on a peripheral surface of the operation section 107. The operation section 107 is able to be operated through the operation opening 87 provided in the first cutter frame 69 (refer to FIG. 6). When the user inserts a finger through the operation opening 87 to rotate the operation section 107, the user is able to rotate the drive gear 59 and rotationally move the first blade 53.

The operation section 107 is used, for example, when the first blade 53 does not return to the cutting start position and becomes stuck due to jamming of the recording paper P or the like in the cutter unit 51. That is, when the user opens the cutter unit cover 11 described above and inserts a finger through the operation opening 87 to rotate the operation section 107, the first blade 53 is able to return to the cutting start position.

The drive gear 59 is rotatably supported by the first cutter frame 69. The drive gear 59 is provided in the +Y direction with respect to the second gear section 105 and engages the second gear section 105. The drive gear 59 is provided in the +Z direction with respect to the first blade 53 (refer to FIG. 7). The drive pin 109 protrudes from a second drive end surface 59*b*, which is the −Z direction end surface of the drive gear 59, to the first blade 53 in the −Z direction. The drive pin 109 engages the cutter engaging hole 99 of the first blade 53. When power of the cutter motor 55 is transferred to the drive gear 59 via the power transfer member 57 and when the drive pin 109 rotates about the rotational center of the drive gear 59, the first blade 53 that engages the drive pin 109 rotationally moves.

Here, a rotational position of the drive gear 59 when the first blade 53 is at the cutting start position is referred to as a drive gear home position. When the drive gear 59 completes rotation from the drive gear home position, the first blade 53 rotationally moves clockwise from the cutting start position to the cutting-into position when viewed from the +Z direction side and further rotationally moves counterclockwise from the cutting-into position to the cutting start position. The drive gear 59 illustrated in the drawings, such as in FIG. 10, is at the drive gear home position.

Figure 8:
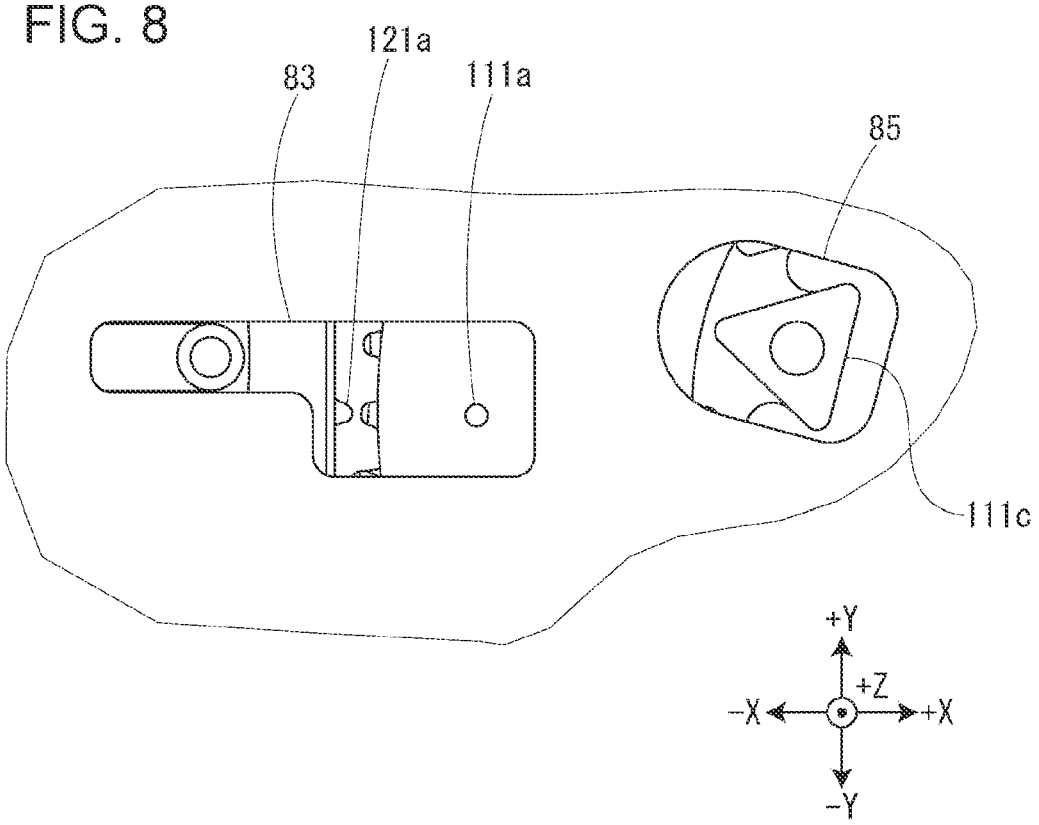
FIG. 8 is an enlarged view of a portion surrounded by line VIII in FIG. 6.

As illustrated in FIGS. 5, 6, and 8, a first drive mark 111*a* and a third drive mark 111*c* are provided on a first drive end surface 59*a*, which is the +Z direction end surface of the drive gear 59. The first drive mark 111*a*, the third drive mark 111*c*, and the drive pin 109 are provided so as to have a given positional relationship in the rotational direction of the drive gear 59. That is, the first drive mark 111*a* is on an inter-gear imaginary line La passing through the rotational center of the drive gear 59 and the rotational center of the detection gear 61 when the drive gear 59 is at the drive gear home position. When the drive gear 59 is at the drive gear home position, the first drive mark 111*a* is visible through the first mark opening 83. The third drive mark 111*c* is provided between the first drive mark 111*a* and the rotational center of the drive gear 59. When the drive gear 59 is at the drive gear home position, the third drive mark 111*c* is visible through the second mark opening 85.

As illustrated in FIG. 10, a second drive mark 111*b* is provided on the second drive end surface 59*b* of the drive gear 59. The second drive mark 111*b* and the drive pin 109 are provided so as to have a given positional relationship in the rotational direction of the drive gear 59. That is, when the drive gear 59 is at the drive gear home position, the second drive mark 111*b* is on the inter-gear imaginary line La.

The detection gear 61 is rotatably supported by the first cutter frame 69 via the detection gear shaft 113. A first-gear-side shaft insertion hole 115 and a second-gear-side shaft insertion hole 117 are provided in the center of the detection gear 61 (refer to FIG. 11). The second-gear-side shaft insertion hole 117 is provided in the −Z direction with respect to the first-gear-side shaft insertion hole 115 and is larger in diameter than the first-gear-side shaft insertion hole 115. The detection gear shaft 113 is inserted into the first-gear-side shaft insertion hole 115 and the second-gear-side shaft insertion hole 117.

The detection gear 61 is provided in the −X direction with respect to the drive gear 59 and engages the drive gear 59. The rotational rate of the detection gear 61 is the same as the rotational rate of the drive gear 59. That is, the number of teeth of the detection gear 61 is the same as the number of teeth of the drive gear 59.

Figure 11:
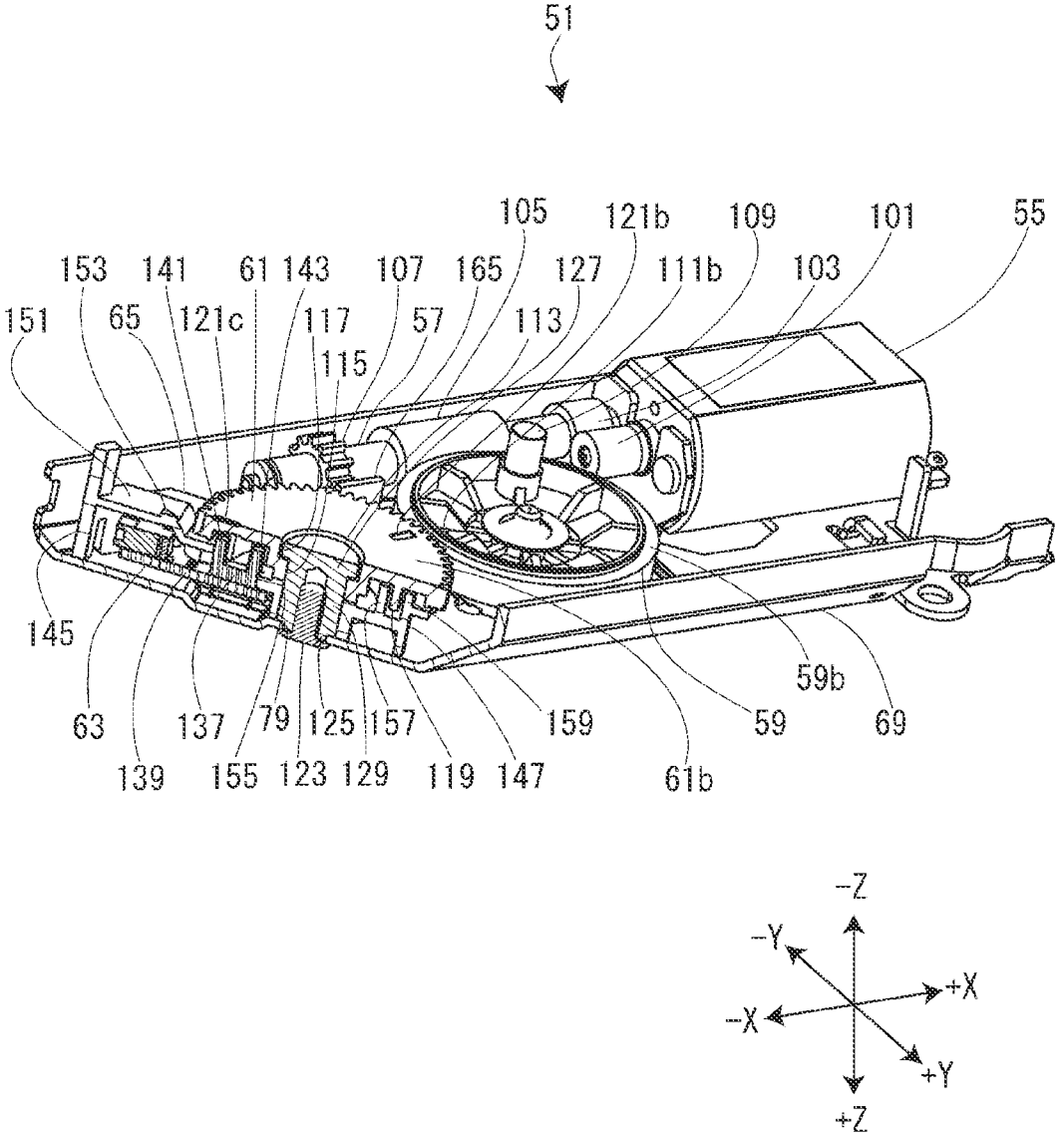
FIG. 11 is a sectional view along line XI-XI in FIG. 10.
Figure 12:
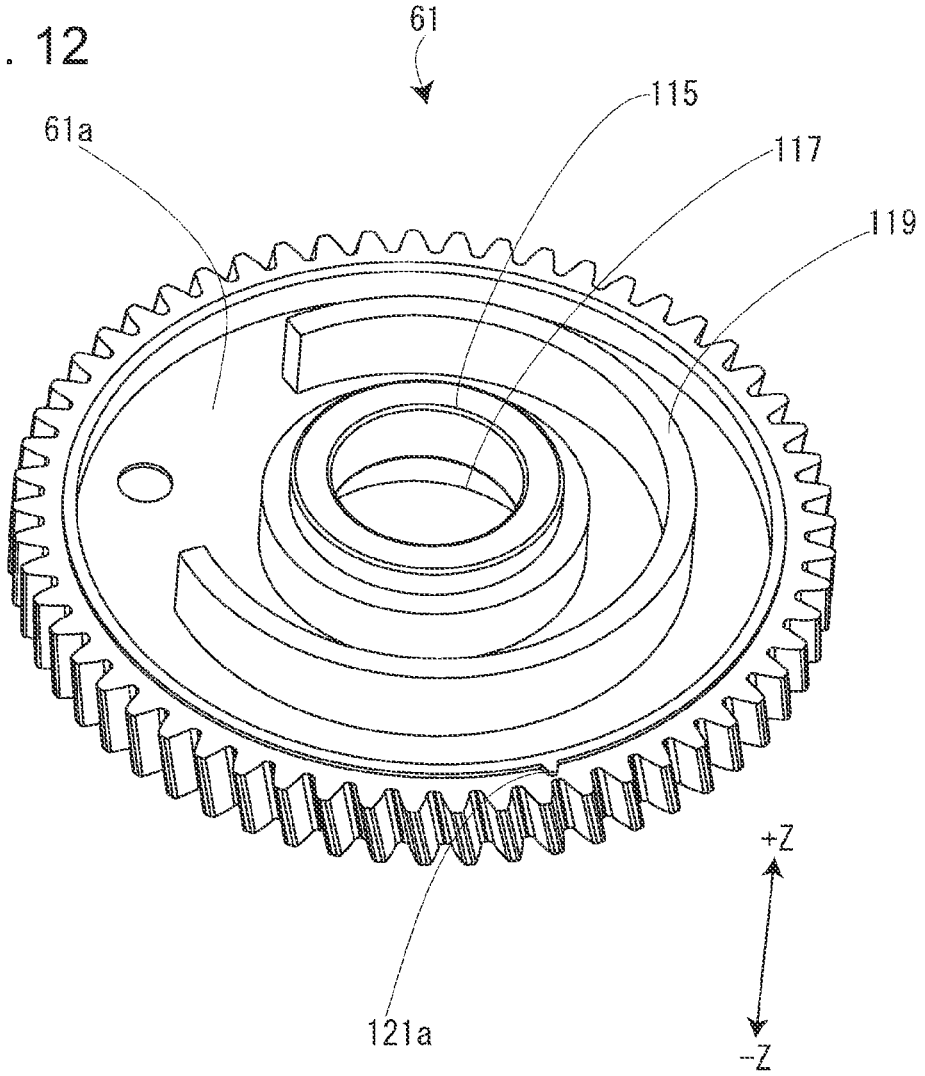
FIG. 12 is a perspective view of a detection gear.

As illustrated in FIG. 12, a rotator 119 protrudes from a first detection end surface 61*a*, which is the +Z direction end surface of the detection gear 61, in the +Z direction. The rotator 119 has a substantially arced shape about the rotational center of the detection gear 61. The rotator 119 rotates in conjunction with the drive gear 59. In other words, the rotator 119 rotates upon rotation of the drive gear 59. That is, when the detection gear 61 that engages the drive gear 59 rotates, the rotator 119 rotates about the rotational center of the detection gear 61. The rotational rate of the rotator 119 is the same as the rotational rate of the drive gear 59. When the rotator 119 rotates upon rotation of the detection gear 61, the rotator 119 passes between a light-emitting element 141 and a light-receiving element 143 of the photosensor 63. That is, the rotator 119 functions as a light-blocking member for blocking detection light emitted from the light-emitting element 141 to the light-receiving element 143. Note that FIG. 11 illustrates a state in which the rotator 119 is not located between the light-emitting element 141 and the light-receiving element 143. As described below, when the detection light is not blocked by the rotator 119, the photosensor 63 outputs a first detection signal, and when the detection light is blocked by the rotator 119, the photosensor 63 outputs a second detection signal.

Here, a rotational position of the detection gear 61 when the rotator 119 causes the photosensor 63 to output the first detection signal, that is, when the rotator 119 is not located between the light-emitting element 141 and the light-receiving element 143, is referred to as a detection gear home position. The detection gear 61 illustrated in the drawings, such as in FIG. 10, is at the detection gear home position.

As illustrated in FIGS. 6 and 8, a first detection mark 121*a* is provided on the first detection end surface 61*a* of the detection gear 61. The first detection mark 121*a* and the rotator 119 are provided so as to have a given positional relationship in the rotational direction of the drive gear 59. That is, when the detection gear 61 is at the detection gear home position, the first detection mark 121*a* is on the inter-gear imaginary line La. When the detection gear 61 is at the detection gear home position, the first detection mark 121*a* is visible through the first mark opening 83.

As illustrated in FIG. 10, a second detection mark 121*b* and a third detection mark 121*c* are provided on a second detection end surface 61*b*, which is the −Z direction end surface of the detection gear 61. The second detection mark 121*b*, the third detection mark 121*c*, and the rotator 119 are provided so as to have a given positional relationship in the rotational direction of the detection gear 61. That is, when the detection gear 61 is at the detection gear home position, the second detection mark 121*b* is on the inter-gear imaginary line La. When the detection gear 61 is at the detection gear home position, the third detection mark 121*c* is on a cover imaginary line Lb passing through the rotational center of the detection gear 61 and a cover mark 153 described later.

As described above, the second drive mark 111*b* is provided on the second drive end surface 59*b* of the drive gear 59, the second detection mark 121*b* and the third detection mark 121*c* are provided on the second detection end surface 61*b* of the detection gear 61, and the cover mark 153 is provided on the −Z direction surface of the cover member 65. Thus, when assembling the cutter unit 51, a worker matches the third detection mark 121*c* of the detection gear 61 with the cover mark 153 of the cover member 65, that is, positions the third detection mark 121*c* on the cover imaginary line Lb, as illustrated in FIG. 10 and is thus able to position the detection gear 61 at the detection gear home position. At this time, the second detection mark 121*b* of the detection gear 61 is on the inter-gear imaginary line La.

Next, the worker matches the second drive mark 111*b* of the drive gear 59 with the second detection mark 121*b* of the detection gear 61, that is, positions the second drive mark 111*b* on the inter-gear imaginary line La, and is thus able to position the drive gear 59 at the drive gear home position. In this manner, by using the second drive mark 111*b*, the second detection mark 121*b*, the third detection mark 121*c*, and the cover mark 153, the worker is able to easily position the drive gear 59 at the drive gear home position and the detection gear 61 at the detection gear home position.

Note that, although a procedure for positioning the drive gear 59 and the detection gear 61 has been described here by exemplifying a procedure in which the worker matches the third detection mark 121*c* of the detection gear 61 with the cover mark 153 of the cover member 65 and then matches the second drive mark 111*b* of the drive gear 59 with the second detection mark 121*b* of the detection gear 61, the procedure is not limited thereto. For example, the worker may match the second drive mark 111*b* of the drive gear 59 with the second detection mark 121*b* of the detection gear 61, that is, position the second drive mark 111*b* and the second detection mark 121*b* on the inter-gear imaginary line La, by using neither the third detection mark 121*c* nor the cover mark 153. Also in this instance, the worker is able to position the drive gear 59 at the drive gear home position and the detection gear 61 at the detection gear home position.

As described above, the first drive mark 111*a* and the third drive mark 111*c* are provided on the first drive end surface 59*a* of the drive gear 59, and the first detection mark 121*a* is provided on the first detection end surface 61*a* of the detection gear 61. The first mark opening 83 and the second mark opening 85 are provided in the first cutter frame 69. Thus, to return the first blade 53 to the cutting start position by rotating the operation section 107, the user rotates the operation section 107 until the third drive mark 111*c* is visible through the second mark opening 85 as illustrated in FIGS. 6 and 8, and the user is thus able to return the first blade 53 to the cutting start position. By viewing the first drive mark 111*a* and the first detection mark 121*a* through the first mark opening 83, the worker is able to check the drive gear 59 at the drive gear home position and the detection gear 61 at the detection gear home position.

Figure 13:
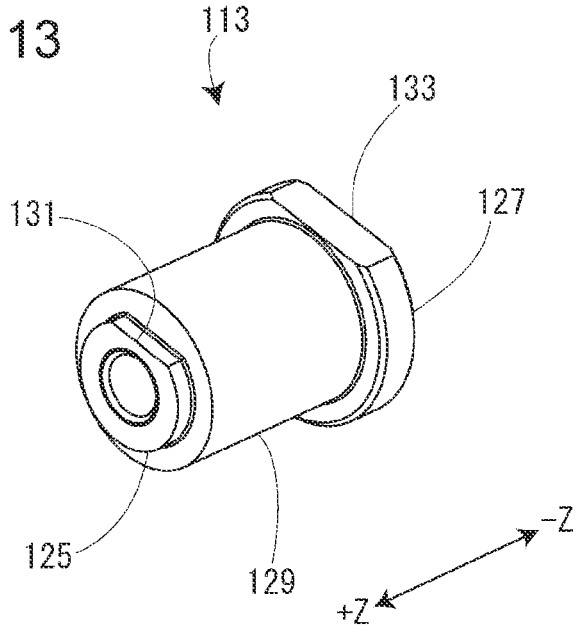
FIG. 13 is a perspective view of a detection gear shaft.

As illustrated in FIGS. 11 and 13, the detection gear shaft 113 is fixed to the first cutter frame 69 by a shaft fixing screw 123. The detection gear shaft 113 includes the first shaft end 125, a second shaft end 127, and a shaft middle section 129.

The first shaft end 125 is provided in the +Z direction end of the detection gear shaft 113 and is smaller in diameter than the shaft middle section 129. The first shaft end 125 includes a first cut section 131 subjected to D-cut processing. The first shaft end 125 is slightly smaller in diameter than the shaft engaging hole 79, which is provided in the first cutter frame 69, and engages the shaft engaging hole 79. The first shaft end 125 subjected to D-cut processing engages the shaft engaging hole 79, which corresponds to the D-shaped hole, thus suppressing the detection gear shaft 113 from rotating.

The second shaft end 127 is provided in the −Z direction end of the detection gear shaft 113 and is larger in diameter than the shaft middle section 129. The second shaft end 127 is slightly smaller in diameter than the second-gear-side shaft insertion hole 117 and engages the second-gear-side shaft insertion hole 117. The second shaft end 127 includes a second cut section 133 subjected to D-cut processing. The second cut section 133 is provided at the same position as the first cut section 131 in a circumferential direction of the detection gear shaft 113.

The shaft middle section 129 is located between the first shaft end 125 and the second shaft end 127 and has a substantially column-like shape. The shaft middle section 129 is slightly smaller in diameter than the first-gear-side shaft insertion hole 115 and a cover-side shaft insertion hole 155 described later and engages the first-gear-side shaft insertion hole 115 and the cover-side shaft insertion hole 155.

When assembling the cutter unit 51, the detection gear shaft 113 is inserted into the second-gear-side shaft insertion hole 117, the first-gear-side shaft insertion hole 115, and the cover-side shaft insertion hole 155 in this order from the −Z direction side and is screwed by the shaft fixing screw 123 in a state in which the first shaft end 125 engages the shaft engaging hole 79. The first cut section 131 of the first shaft end 125 needs to be aligned with the hole linear section 89 of the shaft engaging hole 79 to cause the first shaft end 125 to engage the shaft engaging hole 79. Here, since the first cut section 131 is hidden by the detection gear 61 and the cover member 65 and is not visible to the worker, in the configuration in which the second shaft end 127 includes no second cut section 133, which differs from the present embodiment, it is difficult for the worker to identify the orientation of the first cut section 131, thus requiring time and effort to cause the first shaft end 125 to engage the shaft engaging hole 79.

On the other hand, in the present embodiment, since the second shaft end 127 has the second cut section 133 provided at the same position as the first cut section 131 in the circumferential direction of the detection gear shaft 113, the worker is able to identify the orientation of the first cut section 131 by viewing the second cut section 133. That is, by orienting the second cut section 133 in the −X direction so as to be aligned with the hole linear section 89 as illustrated in FIG. 10, the worker is able to align the first cut section 131 with the hole linear section 89 and cause the first shaft end 125 to engage the shaft engaging hole 79 smoothly. Also when the orientation of the second cut section 133 deviates from the orientation of the hole linear section 89, by inserting forceps or the like into a gap generated between an inner circumferential surface of the second-gear-side shaft insertion hole 117 and the second cut section 133 to rotate the detection gear shaft 113, the worker is able to align the second cut section 133 with the hole linear section 89 and cause the first shaft end 125 to engage the shaft engaging hole 79.

As illustrated in FIG. 11, the photosensor 63 is located in the −X direction end of the first cutter frame 69 and provided between the first cutter frame 69 and the cover member 65. The photosensor 63 is fixed to the cover member 65 by a sensor screw 135 (refer to FIG. 7). That is, the photosensor 63 is supported by the first cutter frame 69 via the cover member 65. The photosensor 63 is provided in the +Z direction with respect to the detection gear 61.

The photosensor 63 includes a light-receiving/emitting section 137 and a sensor substrate 139. The light-receiving/emitting section 137 includes the light-emitting element 141 and the light-receiving element 143, is provided at the sensor substrate 139, and protrudes from the sensor substrate 139 in the −Z direction. The light-receiving/emitting section 137 is provided on a rotation path of the rotator 119. Thus, as described above, when the rotator 119 rotates upon rotation of the detection gear 61, the rotator 119 passes between the light-emitting element 141 and the light-receiving element 143. As a result, the detection light emitted from the light-emitting element 141 to the light-receiving element 143 is switched between a state of being blocked by the rotator 119 and a state of not being blocked by the rotator 119. Note that, although the light-receiving element 143 is provided inward of the light-emitting element 141 in the radial direction of the detection gear 61 in FIG. 11, the light-emitting element 141 may be provided inward of the light-receiving element 143 in the radial direction of the detection gear 61.

The sensor substrate 139 outputs either the first detection signal or the second detection signal in accordance with whether or not the detection light emitted from the light-emitting element 141 to the light-receiving element 143 is blocked by the rotator 119. That is, as described above, when the detection light is not blocked by the rotator 119, the sensor substrate 139 outputs the first detection signal, and when the detection light is blocked by the rotator 119, the sensor substrate 139 outputs the second detection signal. Note that the first detection signal and the second detection signal may be, for example, signals that differ from each other in voltage or current.

The first detection signal or the second detection signal that is output from the sensor substrate 139 is received by a control circuit (not illustrated) provided in the printing apparatus 1. The control circuit includes a processor and memory. When the first detection signal is received, the control circuit determines that the first blade 53 is at the cutting start position. When the second detection signal is received, the control circuit determines that the first blade 53 is not at the cutting start position.

After a portion of the recording paper P, which is to be cut, is fed to the automatic cutter 37, the control circuit determines whether or not the first detection signal is received from the photosensor 63. When determining that the first detection signal is received from the photosensor 63, the control circuit determines that the first blade 53 is at the cutting start position, and the control circuit operates the cutter motor 55 to start the cutting operation performed by the first blade 53. Note that, when determining that the first detection signal is not received from the photosensor 63, that is, determining that the second detection signal is received, the control circuit performs error processing.

After the cutting operation performed by the first blade 53 starts, the control circuit determines whether or not the first detection signal is received from the photosensor 63. When determining that the first detection signal is not received from the photosensor 63, that is, determining that the second detection signal is received, the control circuit determines that the first blade 53 has not returned to the cutting start position, and the control circuit continues the operation of the cutter motor 55. When determining that the first detection signal is received from the photosensor 63, the control circuit determines that the first blade 53 has returned to the cutting start position, and the control circuit stops the cutter motor 55 to end the cutting operation performed by the first blade 53.

Figure 14:
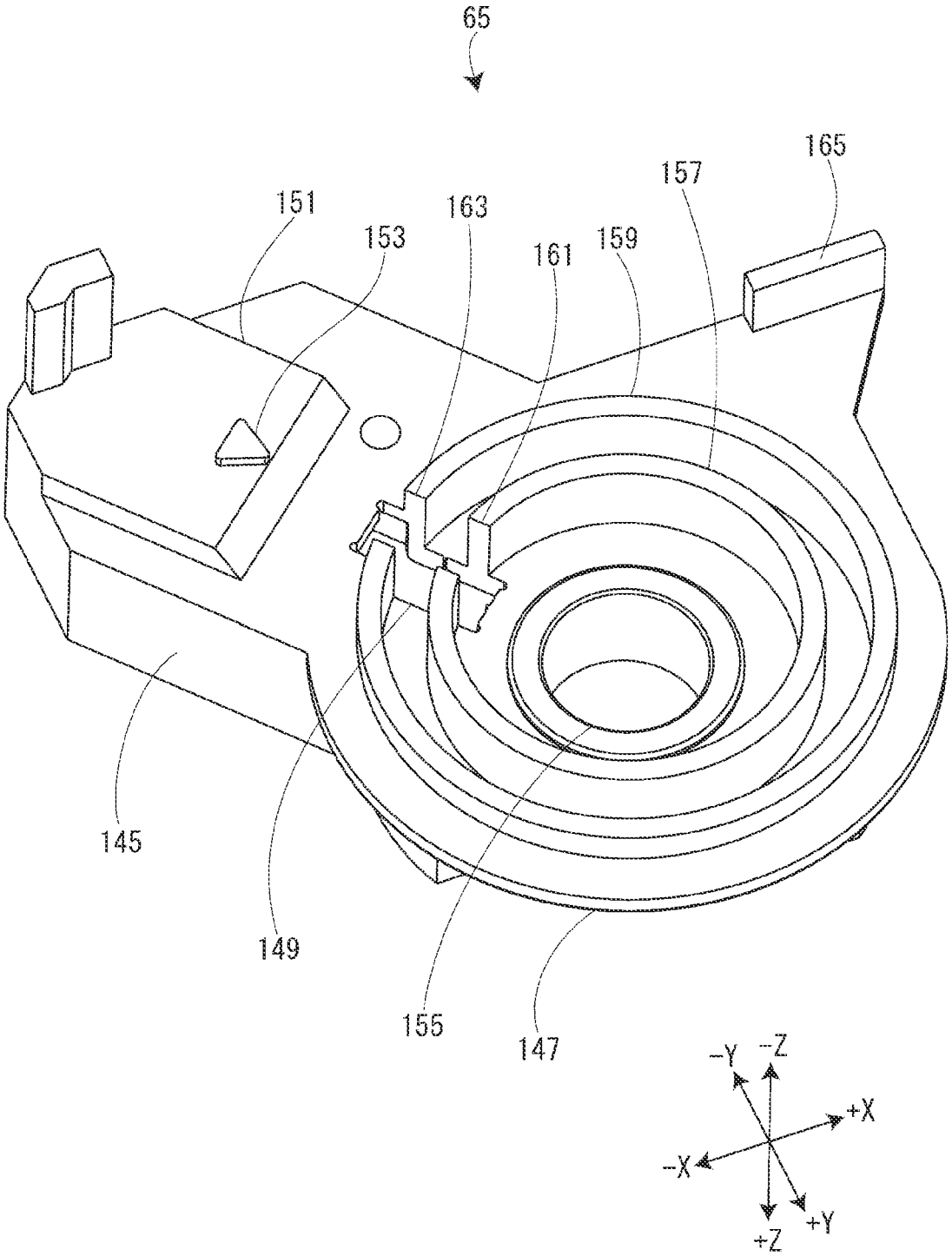
FIG. 14 is a perspective view of a cover member.

As illustrated in FIGS. 11 and 14, the cover member 65 is located in the −X direction end of the first cutter frame 69 and provided between the first cutter frame 69 and the detection gear 61. The cover member 65 includes a sensor container 145 and a gear facing section 147.

The sensor container 145 has a flat substantially polygonal prism shape that is open on the +Z direction side. The sensor container 145 accommodates the sensor substrate 139 and covers the sensor substrate 139 between the sensor container 145 and the first cutter frame 69. That is, the −Z direction side and the periphery of the sensor substrate 139 are covered by the sensor container 145, and the +Z direction side of the sensor substrate 139 is covered by the first cutter frame 69. A sensor opening 149 is provided in the −Z direction wall of the sensor container 145. The light-receiving/emitting section 137 of the photosensor 63 protrudes from the sensor opening 149 in the −Z direction.

When the sensor substrate 139 is covered by the sensor container 145 as described above, it is possible to suppress foreign substances from entering the sensor substrate 139. This makes it possible to suppress an error in the detection result from the photosensor 63 due to entry of foreign substances and suppress a failure of the photosensor 63 due to entry of foreign substances. Here, examples of foreign substances include paper dust and paper pieces generated when the recording paper P is cut, grease spattered from a drive section of the cutter unit 51, and water that is spilled by the user and enters through the discharge port 15.

A cover base 151 protruding in the −Z direction is provided on the −Z direction surface of the sensor container 145, that is, an outer surface of the cover member 65. The cover base 151 has a substantially rectangular shape elongated in the radial direction of the detection gear 61 when viewed from the −Z direction side. The cover mark 153 is provided on the −Z direction surface of the cover base 151 in a portion closest to the rotational center of the detection gear 61.

The gear facing section 147 has a substantially circular plate shape and faces the first detection end surface 61*a* of the detection gear 61. The cover-side shaft insertion hole 155 into which the detection gear shaft 113 described above is inserted is provided in substantially the center of the gear facing section 147. The cover-side shaft insertion hole 155 is substantially the same in diameter as the first-gear-side shaft insertion hole 115 described above.

A first annular wall 157 and a second annular wall 159 protrude from the −Z direction surface of the gear facing section 147 to the detection gear 61 in the −Z direction. The first annular wall 157 and the second annular wall 159 are formed concentrically around the center of the cover-side shaft insertion hole 155. The first annular wall 157 is provided along the inner side of the rotation path of the rotator 119, and the second annular wall 159 is provided along the outer side of the rotation path of the rotator 119. That is, the rotator 119 is located between the first annular wall 157 and the second annular wall 159.

A first cut-out section 161 is provided in the first annular wall 157 at a position corresponding to the sensor opening 149. Similarly, a second cut-out section 163 is provided in the second annular wall 159 at a position corresponding to the sensor opening 149. The light-receiving/emitting section 137 protruding from the sensor opening 149 is located in the first cut-out section 161 and the second cut-out section 163.

Since the first annular wall 157 is provided along the inner side of the rotation path of the rotator 119 and the second annular wall 159 is provided along the outer side of the rotation path of the rotator 119 as described above, it is possible to suppress foreign substances or ambient light from entering the rotation path of the rotator 119. This makes it possible to suppress an error in the detection result from the photosensor 63 due to entry of foreign substances or ambient light and suppress a failure of the photosensor 63 due to entry of foreign substances.

Note that a pinching suppressing section 165 protrudes from the −Z direction surface of the gear facing section 147 in the −Z direction. The pinching suppressing section 165 is provided between the operation section 107 described above and a portion in which the drive gear 59 engages the detection gear 61 (refer to FIG. 11). The pinching suppressing section 165 suppresses a finger of the user inserted through the operation opening 87 to operate the operation section 107 from being pinched between the drive gear 59 and the detection gear 61.

As described above, according to the printing apparatus 1 of the present embodiment, in the cutter unit 51, the sensor substrate 139 is covered by the sensor container 145, thus making it possible to suppress foreign substances from entering the sensor substrate 139. In addition, according to the printing apparatus 1 of the present embodiment, in the cutter unit 51, the first annular wall 157 is provided along the inner side of the rotation path of the rotator 119, and the second annular wall 159 is provided along the outer side of the rotation path of the rotator 119, thus making it possible to suppress foreign substances or ambient light from entering the rotator 119.

Other Modified Examples

Needless to say, the disclosure is not limited to the embodiment described above and can employ various configurations without departing from the scope of the disclosure. For example, the embodiment described above can be changed to incorporate the following aspects in addition to those described above. A configuration in which the embodiment and a modified example are combined may be adopted.

The rotator 119 is not limited to being configured to be provided in the detection gear 61 as long as the rotator 119 rotates in conjunction with the drive gear 59. For example, the rotator 119 may be configured to be provided in the drive gear 59, in a gear that rotates integrally with the drive gear 59, in a gear that does not engage the drive gear 59 but rotates by receiving power from the drive gear 59, or in a gear located between the cutter motor 55 and the drive gear 59.

The cover member 65 is not limited to being configured to include both the first annular wall 157 and the second annular wall 159 and may be configured to include either the first annular wall 157 or the second annular wall 159.

The sensor substrate 139 is not limited to being configured to output the first detection signal, by which the control circuit determines that the first blade 53 is at the cutting start position, when the detection light is not blocked by the rotator 119. That is, the sensor substrate 139 may be configured to output the first detection signal, by which the control circuit determines that the first blade 53 is at the cutting start position, when the detection light is blocked by the rotator 119. In this instance, the position of the rotator 119 in the detection gear 61 may be changed such that the first blade 53 is at the cutting start position when the detection light is blocked by the rotator 119.

Additional Notes

Hereinafter, additional notes on a printing apparatus will be described.

A printing apparatus includes: a first blade that cuts a printing medium; a cutter motor; a drive gear that engages the first blade and is rotated by the cutter motor to drive the first blade; a rotator that rotates in conjunction with the drive gear; a photosensor that includes a light-receiving/emitting section including a light-emitting element and a light-receiving element and that includes a sensor substrate that outputs either a first detection signal or a second detection signal in accordance with whether or not detection light emitted from the light-emitting element to the light-receiving element is blocked by the rotator; a first cutter frame that supports the photosensor; and a cover member that covers the sensor substrate between the cover member and the first cutter frame.

According to such a configuration, since the sensor substrate is covered by the cover member, it is possible to suppress foreign substances from entering the sensor substrate.

Note that the recording paper P is an example of a printing medium.

A printing apparatus includes: a first blade that cuts a printing medium; a cutter motor; a drive gear that engages the first blade and is rotated by the cutter motor to drive the first blade; a rotator that rotates in conjunction with the drive gear; a photosensor that includes a light-receiving/emitting section including a light-emitting element and a light-receiving element and that includes a sensor substrate that outputs either a first detection signal or a second detection signal in accordance with whether or not detection light emitted from the light-emitting element to the light-receiving element is blocked by the rotator; a first cutter frame that rotatably supports the drive gear; and a cover member that includes a first annular wall located along an inner side of a rotation path of the rotator or a second annular wall located along an outer side of the rotation path, or both.

According to such a configuration, since the first annular wall is provided along the inner side of the rotation path or the second annular wall is provided along the outer side of the rotation path, it is possible to suppress foreign substances or ambient light from entering the rotator.

In this instance, the printing apparatus may further include a detection gear that engages the drive gear, in which the detection gear has a first detection end surface, and the rotator is provided on the first detection end surface.

According to such a configuration, the rotator provided on the first detection end surface of the detection gear is able to function as a light-blocking member for blocking detection light.

In this instance, the printing apparatus may further include a second cutter frame that accommodates the first blade, the cutter motor, the drive gear, the detection gear, the photosensor, and the cover member between the second cutter frame and first cutter frame, in which the cutter motor, the drive gear, the detection gear, the photosensor, and the cover member are supported by the first cutter frame, and the first blade is supported by the second cutter frame.

According to such a configuration, a drive region in which the cutter motor and the drive gear are provided and a detection region in which the detection gear, the photosensor, and the cover member are provided are provided between a blade rotational-movement region in which the first blade rotationally moves and the first cutter frame. As a result, space between the first cutter frame and the second cutter frame is able to be used efficiently.

In this instance, the drive gear may have a second drive end surface facing a direction opposite to the first detection end surface, a second drive mark may be provided on the second drive end surface, the second drive mark being located on an inter-gear imaginary line passing through a rotational center of the drive gear and a rotational center of the detection gear when the drive gear is at a drive gear home position, which causes the first blade to be at a cutting start position, the detection gear may have a second detection end surface facing a direction opposite to the first detection end surface, and a second detection mark may be provided on the second detection end surface, the second detection mark being located on the inter-gear imaginary line when the detection gear is at a detection gear home position, which causes the sensor substrate to output the first detection signal.

According to such a configuration, by positioning the second drive mark and the second detection mark on the inter-gear imaginary line, a worker is able to easily position the drive gear at the drive gear home position and the detection gear at the detection gear home position.

In this instance, the drive gear may have a first drive end surface facing a direction identical to the first detection end surface, a first drive mark may be provided on the first drive end surface, the first drive mark being located on an inter-gear imaginary line passing through a rotational center of the drive gear and a rotational center of the detection gear when the drive gear is at a drive gear home position, which causes the first blade to be at a cutting start position, a first detection mark may be provided on the first detection end surface, the first detection mark being located on the inter-gear imaginary line when the detection gear is at a detection gear home position, which causes the sensor substrate to output the first detection signal, a first mark opening may be provided in the first cutter frame, the first drive mark and the first detection mark located on the inter-gear imaginary line being configured to be viewed through the first mark opening.

According to such a configuration, by viewing the first drive mark and the first detection mark through the first mark opening, the worker is able to check the drive gear at the drive gear home position and the detection gear at the detection gear home position.

In this instance, a cover mark may be provided on an outer surface of the cover member, the detection gear may have a second detection end surface facing a direction opposite to the first detection end surface, and a third detection mark may be provided on the second detection end surface, the third detection mark being located on a cover imaginary line passing through a rotational center of the detection gear and the cover mark when the detection gear is at a detection gear home position, which causes the sensor substrate to output the first detection signal.

According to such a configuration, by positioning the third detection mark on the cover imaginary line, the worker is able to position the detection gear at the detection gear home position.

In this instance, the drive gear may have a first drive end surface facing a direction identical to the first detection end surface, a third drive mark may be provided on the first drive end surface, and a second mark opening may be provided in the first cutter frame, the third drive mark being configured to be viewed through the second mark opening when the drive gear is at a drive gear home position, which causes the first blade to be at a cutting start position.

According to such a configuration, by viewing the third drive mark through the second mark opening, a user is able to check the drive gear at the drive gear home position.

In this instance, the printing apparatus may further include a detection gear shaft that is fixed to the first cutter frame and rotatably supports the detection gear, in which a shaft engaging hole may be provided in the first cutter frame, the shaft engaging hole engaging a first shaft end, which is one end of the detection gear shaft in an axial direction of the detection gear shaft, a first cut section subjected to D-cut processing is provided in the first shaft end, a second cut section subjected to D-cut processing is provided in a second shaft end, which is another end of the detection gear shaft in the axial direction of the detection gear shaft, and the first cut section and the second cut section are provided in an identical position in a circumferential direction of the detection gear shaft.

According to such a configuration, by viewing the second cut section, the worker is able to identify the orientation of the first cut section.

In this instance, the printing apparatus may further include an operation section that is operated by a finger to rotate the drive gear without using the cutter motor, in which an operation opening for operating the operation section by a finger is provided in the first cutter frame, and the cover member includes a pinching suppressing section provided between the operation section and a portion in which the drive gear engages the detection gear.

According to such a configuration, it is possible to suppress a finger of the user inserted through the operation opening to operate the operation section from being pinched between the drive gear and the detection gear.

What is claimed is:

1. A printing apparatus comprising:

a first blade configured to cut a printing medium;

a cutter motor;

a drive gear configured to engage the first blade and configured to be rotated by the cutter motor to drive the first blade;

a rotator configured to rotate in accordance with rotation of the drive gear;

a photosensor configured to output a detection signal in accordance with rotation of the rotator and configured to include a light-receiving/emitting section including a light-emitting element and a light-receiving element; and a sensor substrate at which the light-receiving/emitting section is provided, a first cutter frame configured to support the photosensor;

a cover member configured to cover the sensor substrate, wherein the sensor substrate is provided between the cover member and the first cutter frame;

a detection gear that engages the drive gear; and a second cutter frame that accommodates the first blade, the cutter motor, the drive gear, the detection gear, the photosensor, and the cover member between the second cutter frame and first cutter frame, wherein the detection gear has a first detection end surface, the rotator is provided on the first detection end surface, the cutter motor, the drive gear, the detection gear, the photosensor, and the cover member are supported by the first cutter frame, and the first blade is supported by the second cutter frame.

2. The printing apparatus according to claim 1, wherein the drive gear has a second drive end surface facing a direction opposite to the first detection end surface, a second drive mark is provided on the second drive end surface, the second drive mark being located on an inter-gear imaginary line passing through a rotational center of the drive gear and a rotational center of the detection gear when the drive gear is at a drive gear home position, which causes the first blade to be at a cutting start position, the detection gear has a second detection end surface facing a direction opposite to the first detection end surface, and a second detection mark is provided on the second detection end surface, the second detection mark being located on the inter-gear imaginary line when the detection gear is at a detection gear home position, which causes the photosensor to output the detection signal.

3. The printing apparatus according to claim 1, wherein the drive gear has a first drive end surface facing a direction identical to the first detection end surface, a first drive mark is provided on the first drive end surface, the first drive mark being located on an inter-gear imaginary line passing through a rotational center of the drive gear and a rotational center of the detection gear when the drive gear is at a drive gear home position, which causes the first blade to be at a cutting start position, a first detection mark is provided on the first detection end surface, the first detection mark being located on the inter-gear imaginary line when the detection gear is at a detection gear home position, which causes the photosensor to output the detection signal, and a first mark opening is provided in the first cutter frame, the first drive mark and the first detection mark located on the inter-gear imaginary line being configured to be viewed through the first mark opening.

4. The printing apparatus according to claim 1, wherein a cover mark is provided on an outer surface of the cover member, the detection gear has a second detection end surface facing a direction opposite to the first detection end surface, and a third detection mark is provided on the second detection end surface, the third detection mark being located on a cover imaginary line passing through a rotational center of the detection gear and the cover mark when the detection gear is at a detection gear home position, which causes the photosensor to output the detection signal.

5. The printing apparatus according to claim 1, wherein the drive gear has a first drive end surface facing a direction identical to the first detection end surface, a third drive mark is provided on the first drive end surface, and a second mark opening is provided in the first cutter frame, the third drive mark being configured to be viewed through the second mark opening when the drive gear is at a drive gear home position, which causes the first blade to be at a cutting start position.

6. The printing apparatus according to claim 1, further comprising a detection gear shaft that is fixed to the first cutter frame and rotatably supports the detection gear, wherein a shaft engaging hole is provided in the first cutter frame, the shaft engaging hole engaging a first shaft end, which is one end of the detection gear shaft in an axial direction of the detection gear shaft, a first cut section subjected to D-cut processing is provided in the first shaft end, a second cut section subjected to D-cut processing is provided in a second shaft end, which is another end of the detection gear shaft in the axial direction of the detection gear shaft, and the first cut section and the second cut section are provided in an identical position in a circumferential direction of the detection gear shaft.

7. The printing apparatus according to claim 1, further comprising an operation section that is operated by a finger to rotate the drive gear without using the cutter motor, wherein an operation opening for operating the operation section by a finger is provided in the first cutter frame, and the cover member includes a pinching suppressing section provided between the operation section and a portion in which the drive gear engages the detection gear.

8. A printing apparatus comprising:

a first blade configured to cut a printing medium;

a cutter motor;

a drive gear configured to engage the first blade and configured to be rotated by the cutter motor to drive the first blade;

a rotator configured to rotate in accordance with rotation of the drive gear;

a photosensor configured to output a detection signal in accordance with rotation of the rotator and configured to include a light-receiving/emitting section including a light-emitting element and a light-receiving element; and a sensor substrate at which the light-receiving/emitting section is provided, a first cutter frame configured to support the photosensor;

a cover member configured to cover the sensor substrate, wherein the sensor substrate is provided between the cover member and the first cutter frame; and a detection gear that engages the drive gear, wherein the detection gear has a first detection end surface, the rotator is provided on the first detection end surface, the drive gear has a second drive end surface facing a direction opposite to the first detection end surface, a second drive mark is provided on the second drive end surface, the second drive mark being located on an inter-gear imaginary line passing through a rotational center of the drive gear and a rotational center of the detection gear when the drive gear is at a drive gear home position, which causes the first blade to be at a cutting start position, the detection gear has a second detection end surface facing a direction opposite to the first detection end surface, and a second detection mark is provided on the second detection end surface, the second detection mark being located on the inter-gear imaginary line when the detection gear is at a detection gear home position, which causes the photosensor to output the detection signal.

9. A printing apparatus comprising:

a first blade configured to cut a printing medium;

a cutter motor;

a drive gear configured to engage the first blade and configured to be rotated by the cutter motor to drive the first blade;

a rotator configured to rotate in accordance with rotation of the drive gear;

a photosensor configured to output a detection signal in accordance with rotation of the rotator and configured to include a light-receiving/emitting section including a light-emitting element and a light-receiving element; and a sensor substrate at which the light-receiving/emitting section is provided, a first cutter frame configured to support the photosensor;

a cover member configured to cover the sensor substrate, wherein the sensor substrate is provided between the cover member and the first cutter frame; and a detection gear that engages the drive gear, wherein the detection gear has a first detection end surface, the rotator is provided on the first detection end surface, a cover mark is provided on an outer surface of the cover member, the detection gear has a second detection end surface facing a direction opposite to the first detection end surface, and a third detection mark is provided on the second detection end surface, the third detection mark being located on a cover imaginary line passing through a rotational center of the detection gear and the cover mark when the detection gear is at a detection gear home position, which causes the photosensor to output the detection signal.

10. A printing apparatus comprising:

a first blade configured to cut a printing medium;

a cutter motor;

a drive gear configured to engage the first blade and configured to be rotated by the cutter motor to drive the first blade;

a rotator configured to rotate in accordance with rotation of the drive gear;

a photosensor configured to output a detection signal in accordance with rotation of the rotator and configured to include a light-receiving/emitting section including a light-emitting element and a light-receiving element; and a sensor substrate at which the light-receiving/emitting section is provided, a first cutter frame configured to support the photosensor;

a cover member configured to cover the sensor substrate, wherein the sensor substrate is provided between the cover member and the first cutter frame; and a detection gear that engages the drive gear, wherein the detection gear has a first detection end surface, the rotator is provided on the first detection end surface, the drive gear has a first drive end surface facing a direction identical to the first detection end surface, a third drive mark is provided on the first drive end surface, and a second mark opening is provided in the first cutter frame, the third drive mark being configured to be viewed through the second mark opening when the drive gear is at a drive gear home position, which causes the first blade to be at a cutting start position.

11. A printing apparatus comprising:

a first blade configured to cut a printing medium;

a cutter motor;

a drive gear configured to engage the first blade and configured to be rotated by the cutter motor to drive the first blade;

a rotator configured to rotate in accordance with rotation of the drive gear;

a photosensor configured to output a detection signal in accordance with rotation of the rotator and configured to include a light-receiving/emitting section including a light-emitting element and a light-receiving element; and a sensor substrate at which the light-receiving/emitting section is provided, a first cutter frame configured to support the photosensor;

a cover member configured to cover the sensor substrate, wherein the sensor substrate is provided between the cover member and the first cutter frame;

a detection gear that engages the drive gear; and a detection gear shaft that is fixed to the first cutter frame and rotatably supports the detection gear, wherein the detection gear has a first detection end surface, the rotator is provided on the first detection end surface, a shaft engaging hole is provided in the first cutter frame, the shaft engaging hole engaging a first shaft end, which is one end of the detection gear shaft in an axial direction of the detection gear shaft, a first cut section subjected to D-cut processing is provided in the first shaft end, a second cut section subjected to D-cut processing is provided in a second shaft end, which is another end of the detection gear shaft in the axial direction of the detection gear shaft, and the first cut section and the second cut section are provided in an identical position in a circumferential direction of the detection gear shaft.

12. A printing apparatus comprising:

a first blade configured to cut a printing medium;

a cutter motor;

a drive gear configured to engage the first blade and configured to be rotated by the cutter motor to drive the first blade;

a rotator configured to rotate in accordance with rotation of the drive gear;

a photosensor configured to output a detection signal in accordance with rotation of the rotator and configured to include a light-receiving/emitting section including a light-emitting element and a light-receiving element; and a sensor substrate at which the light-receiving/emitting section is provided, a first cutter frame configured to support the photosensor;

a cover member configured to cover the sensor substrate, wherein the sensor substrate is provided between the cover member and the first cutter frame;

a detection gear that engages the drive gear; and an operation section that is operated by a finger to rotate the drive gear without using the cutter motor, wherein the detection gear has a first detection end surface, the rotator is provided on the first detection end surface, an operation opening for operating the operation section by a finger is provided in the first cutter frame, and the cover member includes a pinching suppressing section provided between the operation section and a portion in which the drive gear engages the detection gear.

* * * * *